United States Patent [19]

Braden

[11] Patent Number: 4,919,245

[45] Date of Patent: Apr. 24, 1990

[54] HEAT ECONOMIZER

[76] Inventor: Francis A. Braden, 3627 Paule Ave., St. Louis, Mo. 63125-1715

[21] Appl. No.: 367,801

[22] Filed: Jun. 19, 1989

[51] Int. Cl.[5] ..... F28D 17/00

[52] U.S. Cl. ..... 165/10

[58] Field of Search ..... 126/400; 165/4, 6, 7, 165/9.3, 10 R; 422/175, 181

[56] References Cited

U.S. PATENT DOCUMENTS

| | | | |
|---|---|---|---|
| 476,972 | 6/1892 | Baker . | |
| 3,189,417 | 6/1965 | Houdry et al. | 422/175 |
| 3,638,634 | 2/1972 | Bolitho | 126/41 R |
| 3,853,483 | 12/1974 | Cross | 422/181 |
| 3,978,912 | 9/1976 | Penny et al. | 165/4 |
| 4,010,731 | 3/1977 | Harrison . | |
| 4,094,302 | 6/1978 | Rohr . | |
| 4,121,563 | 10/1978 | Gold . | |
| 4,124,357 | 11/1978 | Akimoto et al. | 422/181 |
| 4,158,358 | 6/1979 | Thomason et al. . | |
| 4,160,523 | 7/1979 | Stevens . | |
| 4,194,496 | 3/1980 | Carlson . | |
| 4,220,196 | 9/1980 | Gawron et al. . | |
| 4,222,365 | 9/1980 | Thomson . | |
| 4,501,318 | 2/1985 | Herbank | 165/4 |

*Primary Examiner*—Carroll B. Dority
*Attorney, Agent, or Firm*—Kalish & Gilster

[57] ABSTRACT

A heat economizing device comprises a perforated container filled with heat exchange material for supported retention within a heating duct or hot air carrying wall space.

5 Claims, 1 Drawing Sheet

FIG. 1
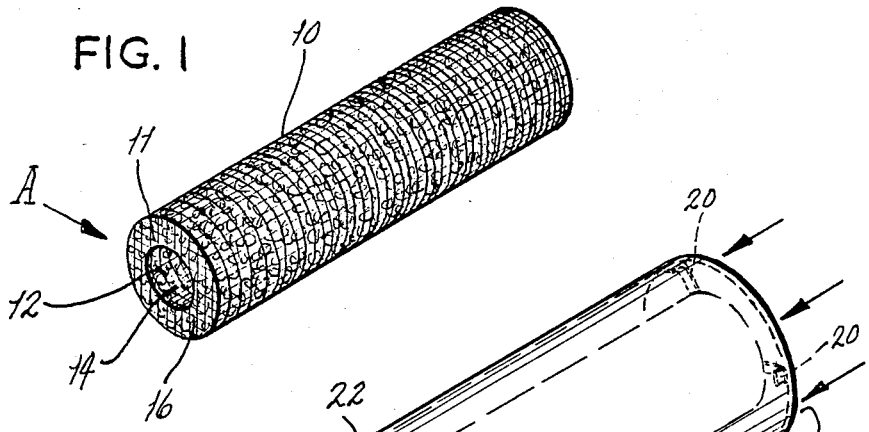
FIG. 2
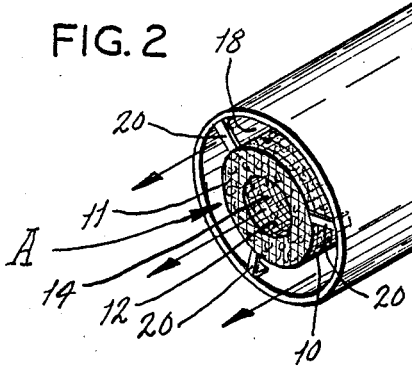
FIG. 3
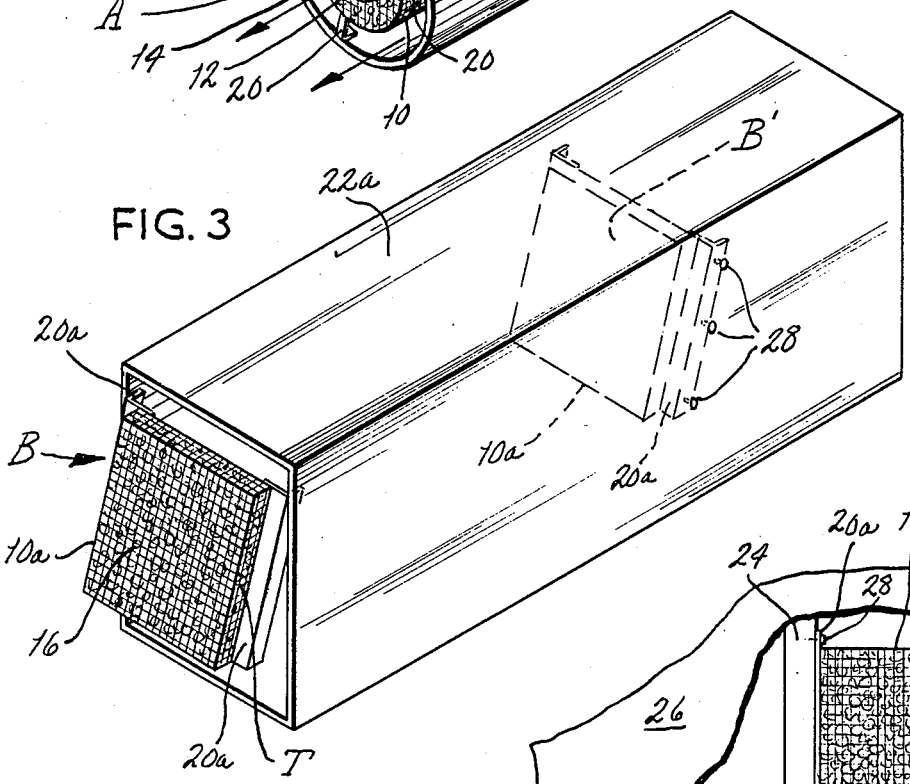
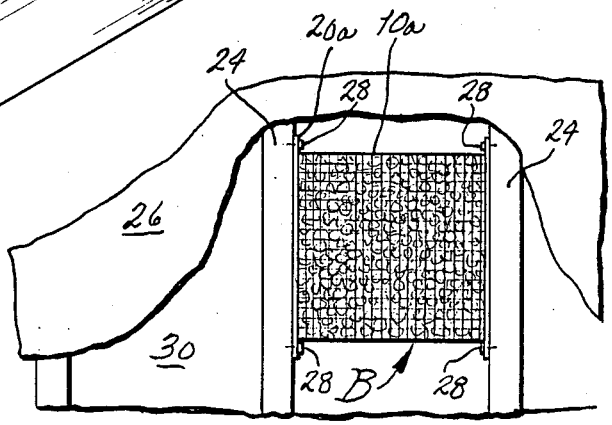
FIG. 4

HEAT ECONOMIZER

BACKGROUND AND SUMMARY OF THE INVENTION

This invention relates generally to the field of energy conserving devices and more particularly to a novel and advantageous heat economizing device using lava rock.

The use of heat-absorbing members or heat storage elements such as stone, lava rock, concrete, sand, pebbles and stone chips is a known concept. For example, patents to Thomson, U.S. Pat. No. 4,222,365, and Gawron, U.S. Pat. No. 4,220,196, disclose heat storage devices that are used with thermal energy systems. Thomson shows a housing containing a large volume of particulate materials such as rocks for the storage of thermal energy. Gawron reveals a heat storage device that comprises a closed reservoir within which is positioned a flexible container having a heat accumulating material such as salt hydrates.

By contrast Carlson, U.S. Pat. No. 4,194,496, reveals a spiral solar heat cell containing rocks as a heat storage means and a series of spaced air ducts for distributing heat. Stevens, U.S. Pat. No. 4,160,523, discloses a solar heat thermal store in the form of an elongated, substantially triangular section rock pile wall, for use in a greenhouse structure.

The patents to Gold and Rohr are more relevant to the present invention. Gold, U.S. Pat. No. 4,121,563, teaches heat-absorbing members such as stone, lava rock and concrete can be placed on rod mesh trays in the open space area of a combustion chamber. These heat absorbing members absorb heat that would normally be lost through the furnace flue opening. To capture such normally lost heat, Gold incorporates in the unoccupied space of a furnace a plurality of heat absorbing members that are carried in spaced relation to each other on suitable trays of rod mesh. Rohr, U.S. Pat. No. 4,094,302, reveals the utilization of heat storage elements that are located within the combustion gas chamber of a furnace. These elements contain holes that are filled with a heat storing refractory material. Furnace flow of hot exhaust gases is blocked or inhibited, thus reducing the temperature of the exhaust gases and saving energy and decreasing fuel consumption.

Patents to Harrison, U.S. Pat. No. 4,010,731, and Thomason et al., U.S. Pat. No. 4,158,358, each disclose a heat-storing apparatus or tank. Thomason et al., shows that dampened rods, concrete and stones can be utilized for heat transfer. In Harrison a heat storage tank removes heat from a heat collector and stores it within a pit that is filled with sand or stone surrounding intake and outtake pipes for distributing and collecting incoming hot liquids and distributing cool outgoing liquids.

U.S. Pat. No. 476,972, to Baker discloses a cylindrical radiator case having a perforated conduit filled with sand, pebbles, stone or chips that receive a heat supply. The radiator contains a perforated bottom section that supports such heat absorbing materials.

The prior art is lacking in a device which permits suspension of a heat-absorbing material within the duct work of currently used home heating systems. Accordingly, it is among the several objects of the present invention to provide a heat economizing device for placement within, for example, round or rectangular air ducts, as well as between wall studs within the walls of a room. Such a heat economizing device would conserve energy by reducing the amount of fuel used to produce a quantity of heat, and thus would lower fuel bills. It would also provide a source of more uniform heat, reducing or eliminating the temperature extremes present with many conventional heating systems.

Other objects of the invention are that it comprises a light-weight, nonflammable, easily available, naturally-occurring substance for use as a heat-storing and heat-emitting element which is capable of suspension within duct work or walls in such a manner as to not impede the flow of air therein and not contribute to air pollution.

In furtherance of these objects, the present invention is briefly, a heat reservoir, comprising a perforated container, having either a central passage or being capable of being positioned so as not to impede the flow of air. The perforated container holds a heat-storing, heat-emitting element, such as lava rock, within the container. Means are provided for suspension of the container and its contents within an air duct or wall.

Other objects and features will be in part apparent and in part pointed out hereinbelow.

BRIEF DESCRIPTION OF THE DRAWINGS

FIG. 1 is a perspective of a wire mesh unit containing lava rock as a heat economizing device embodying one form of the present invention.

FIG. 2 is a perspective of a circular heat duct and the device of FIG. 1 suspended therein.

FIG. 3 is a perspective of a square heat duct and a square-shaped form of the heat economizing device of the present invention.

FIG. 4 is a partial break-away view of a wall showing a rectangular form of the heat economizing device of the present invention located between wall studs.

DESCRIPTION OF THE PREFERRED EMBODIMENT

Referring to the drawings, illustrated in FIG. 1 and generally designated A is the preferred configuration of the heat economizing apparatus of the present invention shown in tubular form. The device consists preferably of a wire mesh (or other material such as perforated sheet metal or plastic) tube having an outer wall 10 and a continuous, concentric inner wall 12 and end portions 11. Device A may be of any length desired. However, typical lengths are in two foot increments. Generally, as the length increases, the heat-absorbing capacity increases. The space between the tube walls is shown filled with a heat exchange substance 16 and closed at the ends by mesh wall 11. Heat exchange substance 16 is preferably crushed lava rock (the inert substance which remains when molten volcanic lava cools), which possesses the inherent capability of heat absorption, retention and gradual emission. A tubular space 14 defined by continuous inner wall 12 provides unimpeded air flow through the length of the lava filled tube A.

FIG. 2 illustrates device A supported by brackets 20 within a tubular heating duct 22, such that space 18 surrounds the outer mesh wall 10 and is encompassed by duct 22. Space 18 provides further uniform and unimpeded air flow along the entire lengthwise surface of device A.

Many shapes are conceivable for the device of the present invention. The perimeter or circumference is dictated by the shape and size of the heating duct in which the container is to be installed. FIGS. 3 and 4 illustrate a square or rectangular cross-sectional embodiment B, B' having a thickness T. Device B consists preferably of a box, the surfaces 10*a* of which are made of wire mesh or other perforated metal. Container B is filled with a heat exchange material 16, preferably lava rock, as in embodiment A. Container B may be supported by brackets 20*a* within a rectangular heating duct 22*a*. FIG. 3 illustrates device B being placed into such a duct 22*a* and device B' placed in phantom. A plurality of such containers may be placed along the length of duct 22*a* for maximizing efficiency of the invention. Alternatively, device B may be supported within a wall 26 by attaching brackets 20*a* to well studs 24 with conventional screws 28. Wall 26 may contain a vertically-disposed heat duct (not shown) or a duct may be formed between conventional wall board 30 and wall studs 24. In either case, heat economizing device B should be of such size and angled position that air can flow freely past the device through the duct or wall space.

In many conventional home heating systems having automatic blower fans, when the furnace is turned on the system must reach a certain temperature before the blower fan is activated. The system duct work and air within it then must heat up before warm air is emitted to the room. Cold room air is forced to the floor as newly warmed air rises. The system shuts off after the room reaches a preset thermostat temperature, cold air eventually settles back through the duct work and into the furnace, thus cooling the ducts as heat is dissipated. When the room temperature drops sufficiently, the furnace burner ignites, fuel is consumed and the cycle repeats.

By contrast, in the new heat economizing system, crushed lava rock 16 collects and retains heat within the duct work during furnace operation as warm air blows around and through the spaces in the rock. If an automatic blower is in use after the furnace blower shuts off and the ducts begin to cool, the lava rock very gradually releases heat into the ducts, or in some systems, the walls. Then, when the economizing device furnace comes on again, the system is still warm enough that the blower can start almost immediately; thus providing more uniform heat, reducing build-up of poisonous gases and overall furnace operation time. Also, the time between furnace cycles is longer because the room temperature decrease is of longer duration. Therefore, a longer period of time lapses before the furnace starts again.

To further illustrate, two-foot lengths of the heat economizing device, as in FIG. 1, can be placed at intervals throughout the duct work of a home. The furnace is turned on, and once the system reaches the thermostat-set temperature, the furnace will shut off, but the contained lava rocks will retain a great deal of heat. The furnace blower may then be allowed to operate (without the furnace itself burning fuel) to force air over the warm lava rocks; thus heating the air and carrying heat into the rooms. After the rocks have substantially cooled, the furnace may again be allowed to operate to reheat the rocks. However, as previously noted, time required to reheat the duct work is minimal because the rocks will still retain some heat. Actual furnace operation time is greatly reduced, and time between furnace cycles is greatly extended. Furthermore, prior to furnace recycling, heat can be obtained without using any fuel, other than the electricity necessary to operate a blower fan. Therefore, heating costs are reduced by making a quantity of fuel last longer, decreasing the necessity of buying more fuel. An additional advantage of the new system as in this example, is the moderation of temperature extremes often experienced, for example with conventional gas heating systems. With such furnaces, the home may get overly warm before the furnace will shut off, followed by uncomfortable chilling before the furnace, and eventually the fan come back on. The present device, by contrast, allows such a system to provide more uniform heat.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. In a building heating system: a heat economizing device comprising; a perforated container having a cross-section, for filling with and retention of a material capable of storing and emitting heat, a quantity of material capable of storing and emitting heat, provided within said container and attachment means for securing the filled container within a ventilation duct forming an elongated heat transfer space having a cross-section greater than the cross-section of said container.

2. The heat economizing device of claim 1, wherein said material capable of storing and emitting heat comprises lava rock.

3. The heat economizing device of claim 2, wherein said perforated container comprises a wire mesh tube having an inner wall and a concentric outer wall; said walls separated by a space for filling with said lava rock, for retention and emission of heat and end walls for retention of said rock therein; said inner wall defining a space extending along the length of said mesh tube, for passage of air therethrough.

4. The heat economizing device of claim 2, wherein said perforated container comprises a wire mesh, rectangular box, having a shape and perimeter such as to permit said container to fit within a rectangular building heat duct with passage of air therethrough.

5. The heat economizing device of claim 1, wherein said attachment means comprises brackets for securing the filled container within an elongated building heat transfer space having a larger internal cross-section than the cross-section of said container for passage of air therearound.

* * * * *